US005288057A

United States Patent [19]

Listau

[11] Patent Number: 5,288,057

[45] Date of Patent: Feb. 22, 1994

[54] ADAPTER AND METHOD FOR POWER STRETCHING CARPETS

[75] Inventor: Ewald E. Listau, Randolph, Wis.

[73] Assignee: Orcon Corporation, Union City, Calif.

[21] Appl. No.: 681,999

[22] Filed: Apr. 8, 1991

[51] Int. Cl.[5] ..... B65H 77/00

[52] U.S. Cl. ..... 254/212

[58] Field of Search ..... 254/200, 209, 210, 211, 254/212, 243; 294/8.6

[56] References Cited

U.S. PATENT DOCUMENTS

| | | | |
|---|---|---|---|
| 549,044 | 10/1895 | Zander . | |
| 639,718 | 12/1899 | Dexter | 254/212 |
| 1,160,647 | 11/1915 | Owens | 254/212 |
| 3,001,762 | 9/1961 | Skolnick . | |
| 3,178,155 | 4/1965 | Bird . | |
| 3,311,347 | 3/1967 | Thompson . | |
| 3,556,479 | 1/1971 | Palachuk . | |
| 3,752,440 | 8/1973 | Ream . | |
| 3,945,609 | 3/1976 | Platek | 254/210 |
| 3,951,382 | 4/1976 | Asbury . | |
| 3,963,216 | 6/1976 | Victor . | |
| 3,977,651 | 8/1976 | Chamberlain . | |
| 3,980,274 | 9/1976 | Ebert . | |
| 4,084,787 | 4/1978 | Kowalczyk . | |
| 4,230,302 | 10/1980 | Crain | 254/212 |
| 4,627,653 | 12/1986 | Koroyasu | 254/200 X |

FOREIGN PATENT DOCUMENTS 1010017 5/1977 Canada .

*Primary Examiner*—John M. Jillions
*Assistant Examiner*—Michael R. Mansen
*Attorney, Agent, or Firm*—Haverstock, Medlen & Carroll

[57] ABSTRACT

A carpet stretching device using a power stretching adapter attached to a standard carpet kicker is provided. The stretching adapter is formed from a frame having an anchor plate attached to the front of the frame for anchoring the device between the wall and tack strip adjacent to the carpet edge to be stretched. A handle is provided which is pivotally attached along its lower portion to the back of the frame. A clamp is located at the bottom of the handle for attaching the handle to a standard carpet kicker adjacent to the head of the kicker, so that the head will be positioned between the anchor plate and the clamp. The device functions by placing the handle upright, placing the anchor between the wall and tack strip, engaging the carpet pile with the carpet kicker head, and pivoting the top of the handle down towards the knee pad of the carpet kicker, forcing the kicker head towards the anchor, thus stretching the carpet. A tucker assembly is also provided for forcing the stretched carpet into engagement with the tack strip.

13 Claims, 2 Drawing Sheets

ADAPTER AND METHOD FOR POWER STRETCHING CARPETS

TECHNICAL FIELD OF THE INVENTION

This invention relates generally to a carpet stretching device, and more particularly to adapters for increasing the power of conventional carpet kickers.

BACKGROUND OF THE INVENTION

The installation of wall-to-wall carpeting often involves stretching the carpet to obtain a smooth, flat installation. This generally entails installing tack strips around the perimeter of the area to be covered with carpet adjacent to the walls of the area. The carpet is then rolled out in the room, usually over some padding, rough cut and seamed. One side of the carpet is attached to the tack strip along one side of a room and then stretched to the other side where the carpet is attached to an opposing tack strip. This process removes any wrinkles or creases in the carpeting, resulting in a flat, safe and visually appealing carpet installation.

During the above-described method of installing carpets, the carpet installer uses various tools for stretching the carpet. The most common tool is the carpet kicker which is typically constructed from an elongated rod having a head with a plurality of downwardly extending carpet gripping members at one end, and at the other end a knee pad. The elongated rod typically includes an offset bend adjacent to the head to provide clearance for the knee pad so that the head will be flat on the floor for maximum engagement with the carpet surface and the elongated rod will be parallel with the floor to transmit to the head the maximum force of a blow to the knee pad.

Carpet installers using this device must get down on their hands and knees, use the carpet gripping head of the kicker to engage the carpet close to the edge to be stretched, and then kick the knee pad using a knee, thus stretching the carpet. The edge of the carpet is then pressed down onto the tack strip, which secures the stretched carpet in place. Any final trimming of the edge is accomplished and the edge is neatly tucked between the tack strip and the wall to give a finished appearance.

Carpet kickers are extremely popular because they are inexpensive devices and because they are particularly useful for stretching carpet in small areas, such as hallways and stairways. However, a carpet kicker has limited power for stretching carpet in larger areas. Additionally, carpet kickers can be difficult to use for extended periods of time, due to the awkward posture which the installer must assume to use the device and because the repeated blows, to the knee pad, required for a complete installation can injure the knee.

Other tools for stretching carpet which avoid the disadvantages of knee kickers are known in the art. For example U.S. Pat. No. 4,084,787 to Kowlaczyk discloses a motorized power stretcher having an anchoring blade for anchoring the device between the tack strip and the wall, and a carpet engaging head which is driven by motor toward the anchoring blade to stretch the carpet. U.S. Pat. No. 3,977,651 to Chamberlain discloses a carpet stretcher having a spring powered carpet engaging head which is placed adjacent to the edge of the carpet to be stretched, a knee pad for use in anchoring the device (by having the operator place his knee against the pad to prevent backward movement of the device), a handle for compressing the spring which drives the carpet engaging head, and a trigger for releasing the compressed spring to drive the carpet engaging head forward, thus stretching the carpet.

Such dedicated power stretchers are well-known, yet they are expensive and beyond the means of some carpet installers. Further, they are generally too large for effective use in small rooms, closets, hallways and stairways. Thus, the possession and use of two dedicated tools, a power stretcher and a knee kicker, is not avoided.

U.S. Pat. No. 3,556,479 to Palachuck discloses an adapter which can be used with a standard carpet kicker for providing additional power, to enable the carpet kicker to be used for stretching carpet in larger areas. The adapter includes a socket into which the knee pad of the carpet kicker is placed, and an anchor which is placed against the wall that the carpeting is being stretched away from. When the carpet kicker head is engaged, and the anchor properly located, the housing containing the knee pad is elevated. The carpet is stretched when the operator steps on the housing, forcing the kicker head away from the anchor. However, this device, while it will provide additional power to the carpet kicker, will also be limited to small areas since it anchors against the wall that the carpet is being stretched away from. Extremely long anchor arms would be required to permit its use in larger areas, and that would significantly increase the cost and the difficulty in transporting the tool.

Accordingly, the need exists for an inexpensive and compact power adapter which can be attached to a standard carpet kicker.

SUMMARY OF THE INVENTION

In one embodiment, the present invention provides an adapter for converting a conventional carpet kicker into a power stretcher. The adapter consists of a frame having at one end an anchor plate for anchoring the assembled stretcher against a tack strip adjacent to the wall that the carpet will be stretched towards. At the other end of the frame is a pivotable handle adapted to be attached at one end to the elongated rod of the carpet kicker adjacent to the head of the carpet kicker, and adapted at its opposite end to be gripped and pivoted away from the direction of stretch.

In yet another embodiment, the present invention includes a spring mounted blade mounted on the frame of the adapter for pushing the carpet onto the tack strip when the stretching operation is complete.

BRIEF DESCRIPTION OF THE DRAWINGS

A better understanding of the invention and its advantages will be apparent from the detailed description taken in conjunction with the accompanying drawings in which.

DETAILED DESCRIPTION OF THE INVENTION

Figure 1:
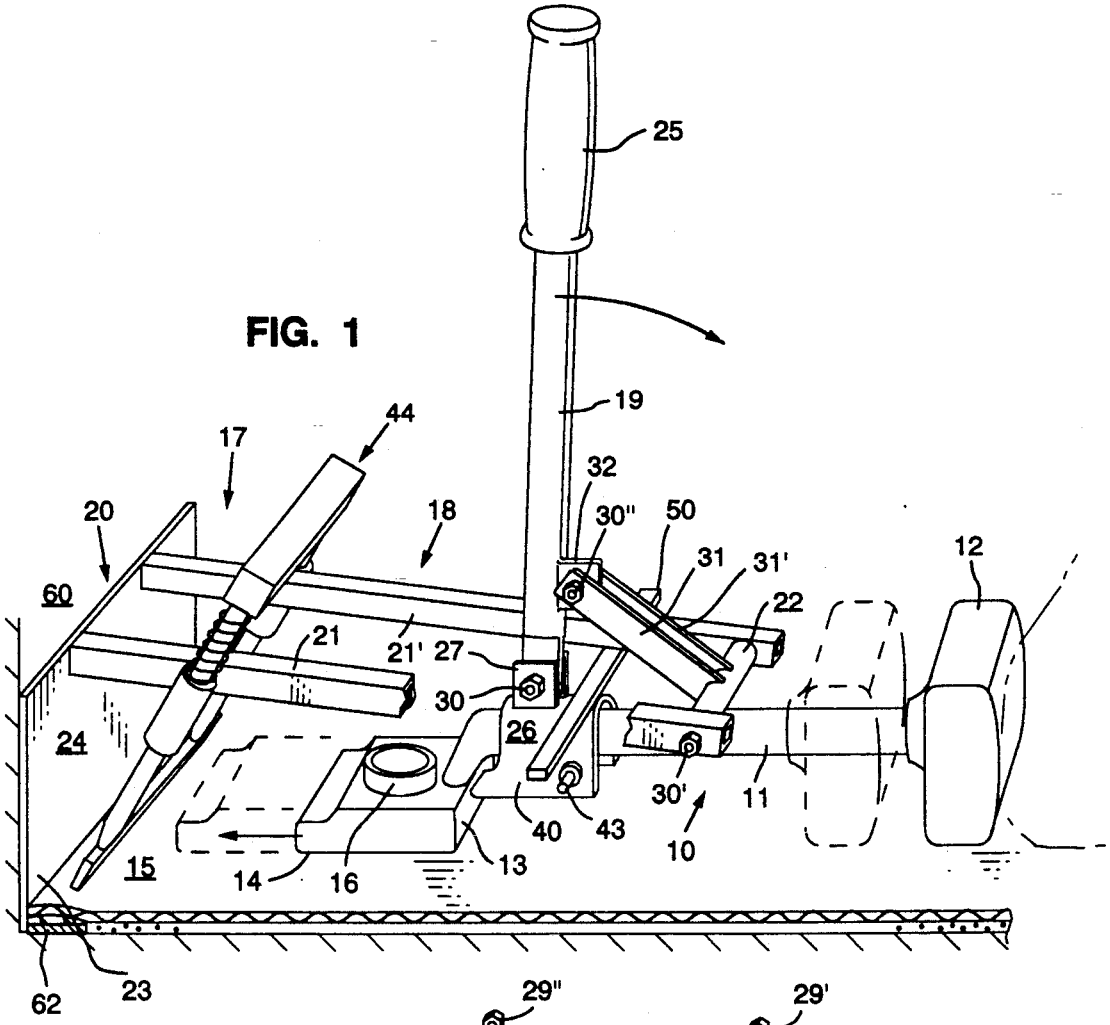
FIG. 1 is a partially broken away, perspective side view of an adapter of the present invention with a conventional carpet kicker attached showing the position of the knee pad and kicker head at the start of the stretch in solid lines and the position of the knee pad and kicker head at the end of the stretch in broken lines.

As shown in FIGS. 1–4, conventional carpet kicker 10 has an elongated rod or member 11, a knee pad 12 and a carpet gripper head 13, including a plurality of downwardly extending teeth 14 which extend below the head 13 to engage the carpet 15. Head 13 also typically includes an adjustment dial 16 for vertically adjusting the position of teeth 14.

The power adapter 17 is basically a frame 18 with a pivoting handle 19. The frame 18 is formed from the anchor plate 20, the transverse brackets or arms 21, 21', and rear member 22. Anchor plate 20 is a thin, rigid plate having a lower portion 23 which is placed between the wall 60 and the tack strip 62 to anchor the power adapter 17 against the tack strip 62. The transverse arms 21, 21' are attached perpendicularly at one end to the upper portion 24 of the anchor plate 20 so that the transverse arms 21, 21' are parallel to and spaced apart from each other. Rear member 22 is attached to the other end of the transverse arms 21, 21' to complete the generally rectangular frame 18.

The pivoting handle 19 includes, at one end, a hand grip 25 to be grasped and pulled by the carpet installer, and at the other end, a clamp 26 for attaching the power adapter to the elongated rod 11 of the carpet kicker 10 at a position adjacent to the angle in elongated rod 11 leading to the head 13.

Figure 2:
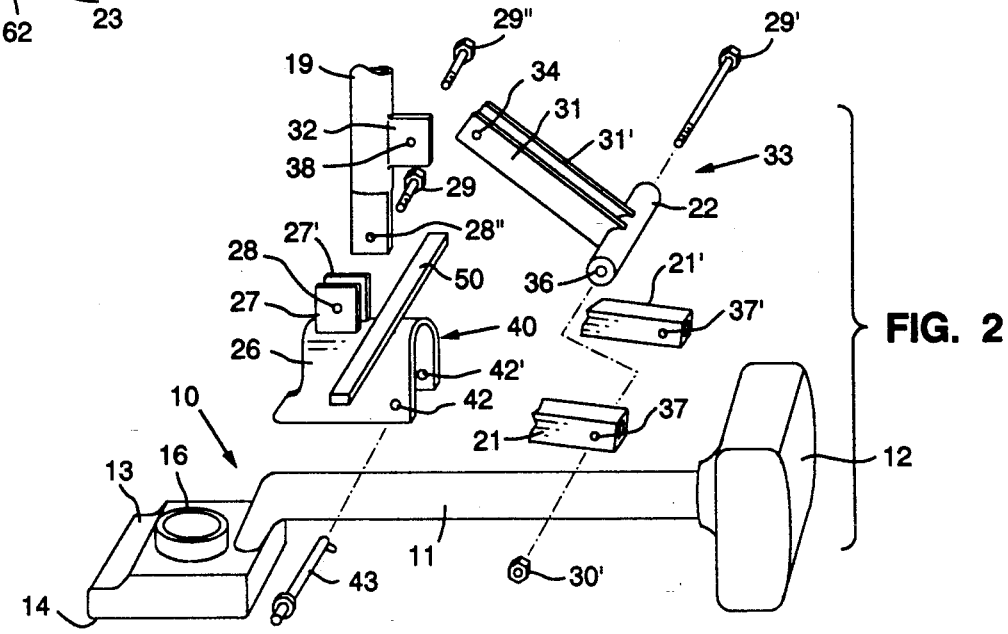
FIG. 2 is a partially exploded view of FIG. 1.

Pivoting handle 19 is pivotally attached to the clamp 26. For example, as shown in FIG. 2, the clamp 26 can be provided with a pair of upstanding flanges 27, 27', spaced for receiving between them the lower portion of pivoting handle 19. Flanges 27, 27' can be provided with a hole 28, 28' each of which is positioned to be aligned with the other hole and with a hole 28" in the lower portion of pivoting handle 19 when the lower portion of pivoting handle 19 is placed between the upstanding flanges 27, 27'. A shoulder bolt 29 can then be inserted through the holes 28, 28", 28' and secured to flanges 27, 27' using a nut 30 to secure the pivoting handle 19 to the clamp 26 while permitting pivotal movement of the handle 19 about the axis of shoulder bolt 29.

The pivoting handle 19 is preferably attached to the frame via fulcrum arms 31, 31' which are attached at one end to the center portion of rear member 22 and pivotally attached at the other end to a handle flange 32. As shown in FIG. 2, the rear member 22 and the two fulcrum arms 31, 31' are preferably formed into a rear section or assembly 33 in which fulcrum arms 31, 31' are attached at one end, for example by welding, to a hollow cylindrical rear member 22 so that fulcrum arms 31, 31' are parallel to and spaced apart from each other, and are perpendicular to the longitudinal axis of the bore 36 through cylinder 22. Fulcrum arm 31, 31' can each be provided with a hole 34, 34' at the end opposite to cylindrical rear member 22. Rear assembly 33 can then be attached to the transverse arms 21, 21' by aligning holes 37 and 37' of transverse arms 21, 21' with bore 36 of cylindrical rear member 22 positioned between them, inserting a shoulder bolt 29' through the aligned holes and bore, and fastening a nut 30' on the end of the shoulder bolt 29 to hold it in place. Attachment of rear assembly 33 to the pivoting handle 19 is accomplished by rotating the cylindrical rear member 22 about the shoulder bolt 29' until the pivoting handle flange 32 is positioned between the fulcrum arms 31, 31' and the holes 34, 34' and 38 are aligned, and inserting a shoulder bolt 29" through the aligned holes 34, 38 and 34' and securing bolt 29" in position by threading a nut 30" onto the threaded end of bolt 29".

As shown in FIGS. 1 and 2, clamp 26 includes a means for attaching and removing the power adapter 17 to a conventional carpet kicker 10. For example, as shown in FIG. 2, clamp 26 can be provided with a downwardly extending inverted "U" shaped bracket 40 which will fit over the elongated rod 11 of the carpet kicker 10 at a position adjacent to the head 13. The bracket 40 can be provided with two arms 41, 41' each of which are longer than the diameter of the elongated rod 11. Each bracket arm 41, 41' is preferably provided with a hole 42, so that hole 42 in bracket arm 41 is aligned with hole 42' in bracket arm 41'. The elongated rod 11 of carpet kicker 10 is then placed between the bracket arms 41, 41', and a locking pin 43 or other suitable fastener is placed through the aligned holes 42, 42' to secure the power adapter 17 to the carpet kicker 10. Clamp 26 can also be provided with guide 50, an elongated bar welded or otherwise attached to the top of the clamp 26 rearwardly of clamp flange 27. Guide 50 provides a bearing surface for transverse arms 21, 21' so that when head 13 is moved by pivoting handle 19, guide 50 will slide along transverse arms 21, 21', and rear member 22 will be held up and out of contact with elongated rod 11 of carpet kicker 10, thus preventing scarring of rod 11 which would otherwise occur if rear member 22 was in contact with rod 11 during the movement of handle 19.

Figure 4:
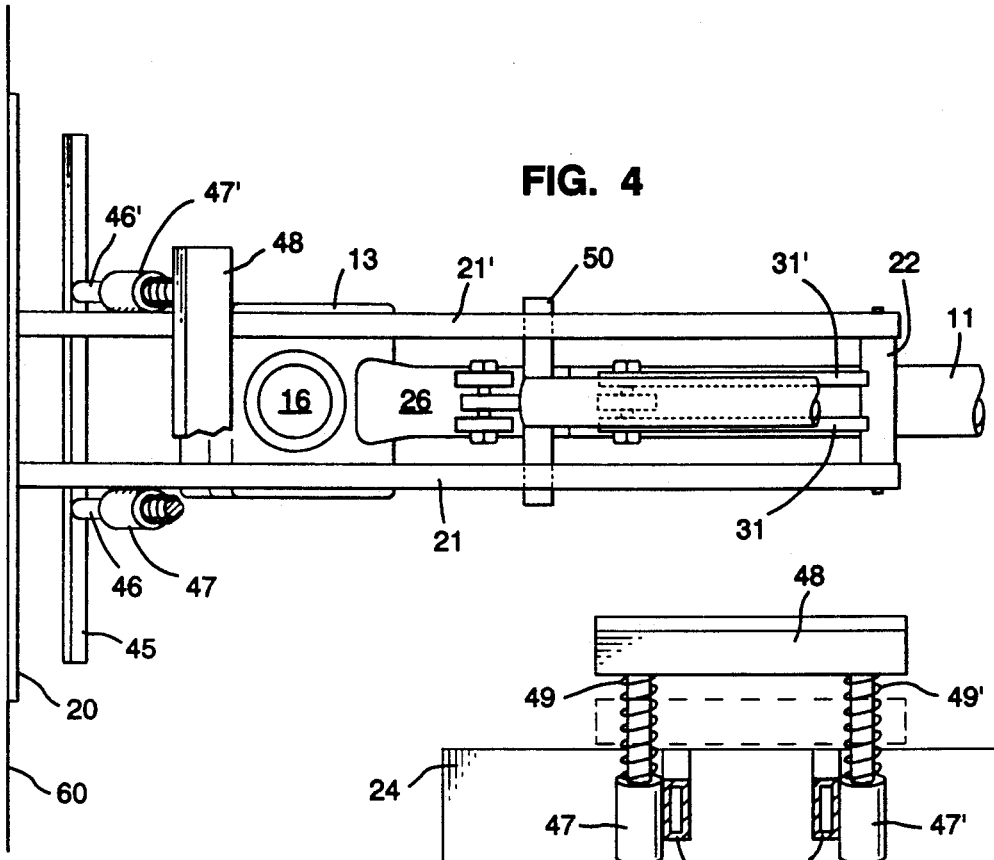
FIG. 4 is a partially broken away top view of the adapter of the present invention as shown in FIG. 3.
Figure 5:
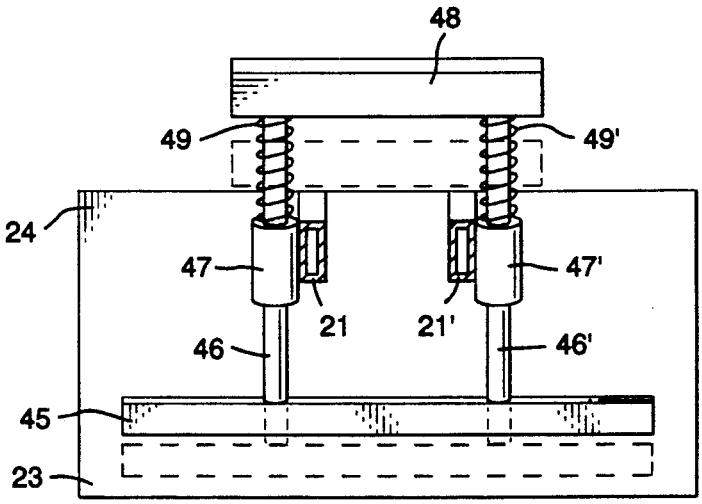
FIG. 5 is a back view taken through line 5—5 of FIG. 3.
Figure 3:
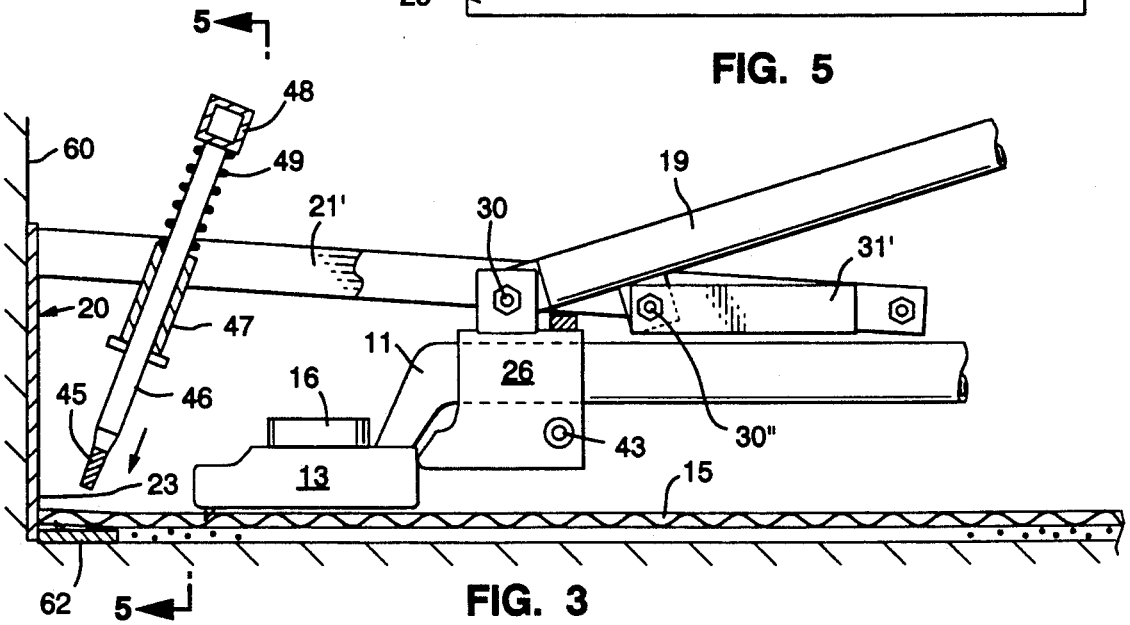
FIG. 3 is a side view of an adapter of the present invention attached to a conventional carpet kicker showing the position of the various components at the end of the stretch.

Preferably included on the power adapter 17 is a carpet tucker 44. As shown in detail in FIGS. 3–5, the carpet tucker 44 has a thin, flat blade 45 the bottom of which is used for pressing the stretched carpet 15 into engagement with the tacks on the tack strip 62. Attached to the top of the blade 45, and extending outward therefrom, is a pair of spaced apart rods 46, 46' each of which pass through a mounting sleeve 47, 47' attached to the transverse arms 21, 21'. The rods 46, 46' terminate in a push-bar 48. Each rod 46, 46' passes through a coil spring 49, 49', which is located between each mounting sleeve 47, 47' and the push bar 48. As shown in solid in FIG. 5, the springs 49, 49' hold the blade 45 above the surface of the carpet 15 until the push bar 48 is depressed (shown in broken line fashion) pushing the blade 45 into contact with the carpet 15, forcing the stretched carpet 15 into engagement with the tack strip 62. As shown in FIGS. 1 and 3–4, the mounting sleeves 47, 47' are preferably attached to the transverse arms 21, 21' at an angle so that the push bar 53 can be struck without interference from the wall 60 or the anchor plate 20, and so that the blade 45 will impact the stretched carpet 15 just in front of the anchor plate 20 above the tack strip 62.

To use a power adapter 17 of the present invention, one attaches the clamp 26 to the elongated rod 11 of a conventional carpet kicker 10 adjacent to the head 13 so that the head 13 of carpet kicker 10 is positioned between clamp 26 and anchor plate 20, as shown in FIG. 1. Pivoting handle 19 is placed in an up position (substantially perpendicular to the elongated rod 11 of carpet kicker 10) and the lower portion 23 of anchor plate 20 is then slid between wall 60 and tack strip 62 along the edge of the carpet 15 which is to be stretched. Head 13 is placed on the carpet 15 so that teeth 14 engage the carpet pile. The bottom edge of the knee pad 12 also rests on the carpet 15. To stretch the carpet 15, the operator simply grasps hand grip 25 and pulls the pivoting handle 19 toward the knee pad 12, forcing the head 13 of knee kicker 10 towards the wall 60, as shown in broken line fashion in FIG. 1. The stretched carpet 15 is then secured on the tack strip 62 by pushing down on the push bar 48 of the carpet tucker 44, compressing springs 49, 49' so that the tucker blade 45 pushes the edge of carpet 15, impaling the edge on the upstanding tacks protruding from tack strip 62.

The invention as shown and described herein provides a compact and easily transportable adapter which will enable a carpet installer to convert his carpet kicker to a power stretcher when needed. One skilled in the art will recognize at once that it would be possible to construct the present invention from a variety of materials and in a variety of different ways. While the preferred embodiments have been described in detail, and shown in the accompanying drawings, it will be evident that various further modification are possible without departing from the scope of the invention as set forth in the appended claims.

What is claimed is:

1. A carpet power stretcher for stretching carpet toward a wall, comprising:

a carpet kicker including an elongated rod having two ends, a knee pad attached to one end of said elongated rod, and a carpet engaging head at the other end of said elongated rod, said elongated rod having an offset bend adjacent to said head;

a power stretching adapter including a frame having a front and a back, an anchoring means attached to the front of the frame for anchoring the front of the frame between said wall and a tack strip, an elongated handle including an upper portion terminating in a grip, a lower portion, and an end, said lower portion of said handle being pivotally attached to the back of said frame, and, a clamping means for removably connecting pivotally the end of said elongated handle to the elongated rod of said carpet kicker;

said clamping means being removably attached to said elongated rod adjacent to said offset bend, such that said head is located between said clamping means and said anchoring means and said handle has a first position in which said handle is substantially perpendicular to said elongated rod, and a second position in which said handle is adjacent to said knee pad, such that when said handle is pivoted from said first position to said second position, said head is moved toward said anchoring means.

2. The power stretcher of claim 1 in which the anchoring means is a relatively thin, flat rigid plate attached to the front of the frame.

3. The power stretcher of claim 1 additionally comprising a means located at the front of said frame for forcing an edge of the carpet into engagement with said tack strip.

4. A carpet power stretching adapter for attachment to a carpet kicker including an elongated rod having two ends, a knee pad attached to one end of said elongated rod, and a carpet engaging head at the other end of said elongated rod, said elongated rod having an offset bend adjacent to said head, said adapter comprising:

a frame having a front and a back;

an anchoring means attached to the front of the frame for anchoring the front of the frame between a wall and a tack strip;

an elongated handle including an upper portion terminating in a grip, a lower portion, and an end, said lower portion of said handle being pivotally attached to the back of said frame; and, a clamping means for removably connecting pivotally the end of said elongated handle to the elongated rod of said carpet kicker adjacent to said offset bend, such that when said clamping means is attached to said carpet kicker, said head is positioned between said clamping means and said anchoring means, and said handle has a first position in which said handle is substantially perpendicular to said elongated rod, and a second position in which said handle is adjacent to said knee pad, such that when said handle is pivoted from said first position to said second position, said head is moved toward said anchoring means.

5. The power stretching adapter of claim 4 in which said anchoring means comprises a thin, substantially rigid plate having an upper portion, a lower portion, a first surface and a second surface, said lower portion formed to fit between said wall and said tack strip.

6. The power stretching adapter of claim 5 in which said frame comprises:

two rigid brackets each having a first end and a second end, the first end of each said bracket being attached substantially perpendicularly to the second surface of the upper portion of said plate, such that the brackets are parallel to and spaced apart from each other;

a rigid rear member attached perpendicularly to the second ends of the brackets; and, a means for pivotally attaching the lower portion of the elongated handle to the rigid rear member.

7. The power stretching adapter of claim 6 in which the means for pivotally attaching the lower portion of the elongated handle is at least one rigid bar having a first end and a second end, said bar being shorter than said rigid brackets, said first end of said rigid bar being pivotally attached to said rigid rear member, and said second end of said rigid bar being adapted to permit pivotal attachment to the lower portion of said elongated handle such that said handle and said rigid bar will pivot in the same plane.

8. The power stretching adapter of claim 6 additionally comprising a means for forcing an edge of the carpet into engagement with said tack strip.

9. The power stretching adapter of claim 8 in which said means for forcing the edge of carpet into engagement with said tack strip comprises:

a tucking blade having a bottom surface for pushing carpet and a top surface;

a push bar attached to the top surface of said tucking blade; and, a means for spring-biasing the tucking blade up away from the carpet until the push bar is pushed.

10. The power stretching adapter of claim 9 additionally comprising:

a pair of rods, each having a first end and a second end, said first end of each said rod attached to the top surface of said tucking blade so that the rods are parallel to and spaced away from each other; and, a mounting sleeve attached to each rigid bracket for slidably receiving the rods; said push bar attached perpendicularly across the second ends of said rods.

11. The power stretching adapter of claim 10 in which said means for holding the tucking blade up away from the surface of the carpet comprises a coil spring slidably received on each rod and located between the push bar and the mounting sleeve.

12. A method for power stretching carpet using a carpet kicker combined with a power stretching adapter, said carpet kicker including an elongated rod having two ends, a knee pad attached to one end of said elongated rod, and a carpet engaging head at the other end of said elongated rod, said elongated rod having an offset bend adjacent to said head, said power stretching adapter including a frame having a front and a back, an anchoring means attached to the front of the frame for anchoring the front of the frame between a wall and a tack strip, an elongated handle including an upper portion terminating in a grip, a lower portion, and an end, the lower portion of the handle being pivotally attached to the back of the frame, and, a clamping means attached to the end of said handle for removably connecting pivotally the end of said elongated handle to the elongated rod of said carpet kicker adjacent to said offset bend, such that when said clamping means is attached to said carpet kicker, said head is positioned between said clamping means and said anchoring means, and said handle has a first position in which said handle is substantially perpendicular to said elongated rod, and a second position in which said handle is adjacent to said knee pad, such that when said handle is pivoted from said first position to said second position, said head is moved toward said anchoring means; said method comprising the steps of:

attaching the power stretching adapter to the carpet kicker by attaching the clamping means to the elongated rod of the carpet kicker at a location adjacent to the offset bend; placing the anchoring means between the wall and the tackstrip; engaging the carpet with the head of the carpet kicker with said handle in the first position;

pivotally moving the handle of the power stretching adapter from the first to the second position, to force the head and the engaged carpet towards the anchoring means

13. The method as set forth in claim 12 wherein the power stretching adapter additionally includes a spring-loaded blade positioned between the anchoring means and the head of the carpet kicker, said method additionally comprising the step of pushing said spring-loaded blade down against an edge of the stretched carpet to force it into engagement with the tack strip after said head and the engaged carpet is forced towards the anchoring means by the movement of the handle from the first position to the second position.

* * * * *